US011282484B1

(12) United States Patent
Lewis et al.

(10) Patent No.: US 11,282,484 B1
(45) Date of Patent: Mar. 22, 2022

(54) ILLUMINATED ACOUSTIC DEVICE

(71) Applicants: The Order Fulfillment Group Inc., Zionsville, IN (US); Grover Musical Products, Inc., Cleveland, OH (US)

(72) Inventors: Edward D Lewis, Brownsburg, IN (US); Cory M Berger, Cleveland, OH (US)

(73) Assignees: The Order Fulfillment Group, Inc., Zionsville, IN (US); Grover Musical Products, Inc., Cleveland, OH (US)

( * ) Notice: Subject to any disclaimer, the term of this patent is extended or adjusted under 35 U.S.C. 154(b) by 0 days.

(21) Appl. No.: 17/133,743

(22) Filed: Dec. 24, 2020

(51) Int. Cl.
*G10D 13/06* (2020.01)
*F21V 33/00* (2006.01)
*F21Y 115/10* (2016.01)

(52) U.S. Cl.
CPC ..... *G10D 13/06* (2013.01); *F21V 33/0056* (2013.01); *F21Y 2115/10* (2016.08)

(58) Field of Classification Search
CPC ..... F21V 33/0056; G10D 13/06
See application file for complete search history.

(56) References Cited

U.S. PATENT DOCUMENTS

| | | | | |
|---|---|---|---|---|
| 4,106,079 | A | 8/1978 | Drury et al. | |
| 5,138,535 | A * | 8/1992 | Aragon, Jr. | A63H 33/30 362/102 |
| 5,509,343 | A * | 4/1996 | Hsu | G10D 13/06 84/418 |
| 6,945,725 | B2 | 9/2005 | Cui | |
| 7,096,617 | B2 * | 8/2006 | Bydalek | B67D 1/0872 222/113 |
| 7,119,265 | B2 | 10/2006 | Sueta, Jr. et al. | |
| 10,325,576 | B2 * | 6/2019 | Finelli, III | G10H 3/14 |
| 2004/0090797 | A1 | 5/2004 | Cohen | |
| 2004/0147201 | A1 | 7/2004 | Cohen | |

* cited by examiner

*Primary Examiner* — Alexander K Garlen
*Assistant Examiner* — Eric T Eide
(74) *Attorney, Agent, or Firm* — Lunsford Patents LLC

(57) ABSTRACT

An illuminated acoustic device is provided including a body, a lighting element, a sensor, and a medium material. The body includes a handle and a hollow chamber extending outward from the handle. The lighting element is arranged within the body and is arranged to illuminate an interior of the hollow chamber. The sensor is positioned within the hollow chamber. The sensor is adapted to control the lighting element. The medium material is arranged within the interior of the hollow chamber.

20 Claims, 4 Drawing Sheets

ILLUMINATED ACOUSTIC DEVICE

TECHNICAL FIELD

This disclosure relates to accessories related to acoustic percussion devices and, in particular, to musical rattles capable of illumination.

BACKGROUND

The statements in this section merely provide background information related to the present disclosure and may not constitute prior art.

A variety of acoustic percussion devices exist, such as rattles and maracas. In some situations, it is desirable to illuminate the acoustic device to create a visual effect. However, coordination of the illumination with the percussive movement of the device can be difficult to achieve. Therefore, a percussive acoustic device which coordinates illumination effects with the percussive movement of the device is desirable.

SUMMARY

Further areas of applicability will become apparent from the description provided herein. It should be understood that the description and specific examples are intended for purposes of illustration only and are not intended to limit the scope of the present disclosure.

In one embodiment, an illuminated acoustic device is provided including a body, a lighting element, a sensor, and a medium material. The body includes a handle and a hollow chamber extending outward from the handle. The lighting element is arranged within the body and is arranged to illuminate an interior of the hollow chamber. The sensor is positioned within the hollow chamber. The sensor is adapted to control the lighting element. The medium material is arranged within the interior of the hollow chamber.

In another embodiment, an illuminated acoustic device is provided including a body, a light-emitting diode, a sensor, and a medium material. The body includes a handle and a hollow chamber coupled to the handle. The light-emitting diode is arranged within the handle and is directed to illuminate an interior of the hollow chamber. The sensor is suspended within the hollow chamber by a flexible element extending between the sensor and the handle. The sensor is adapted to control the light-emitting diode. The medium material is arranged within the interior of the hollow chamber.

In yet another embodiment, a method of manufacturing an illuminated acoustic device is provided including providing a handle portion and a hollow chamber portion, positioning a lighting element, an elongated element, and a sensor, configuring the sensor, and placing a medium within the interior of the hollow chamber portion. The lighting element is positioned within the handle portion. The elongated element extends outward from the handle portion. The sensor is coupled to the elongated element and is suspended within an interior of the hollow chamber portion. The lighting element is arranged to illuminate the interior of the hollow chamber portion. The sensor is configured to selectively activate the lighting element.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

In one example, an illuminated acoustic device is provided including a body, a lighting element, a sensor, and a medium material. The body includes a handle and a hollow chamber extending outward from the handle. The lighting element is arranged within the body and is arranged to illuminate an interior of the hollow chamber. The sensor is positioned within the hollow chamber. The sensor is adapted to control the lighting element. The medium material is arranged within the interior of the hollow chamber.

One technical advantage of the systems and methods described below may be that the illuminated acoustic device may produce a dynamic lighting effect which is coordinated with the percussive movement of device.

Yet another technical advantage of the systems and method described herein may be that the medium material may interact with the lighting element to produce interesting and complex visual displays.

Figure 1:
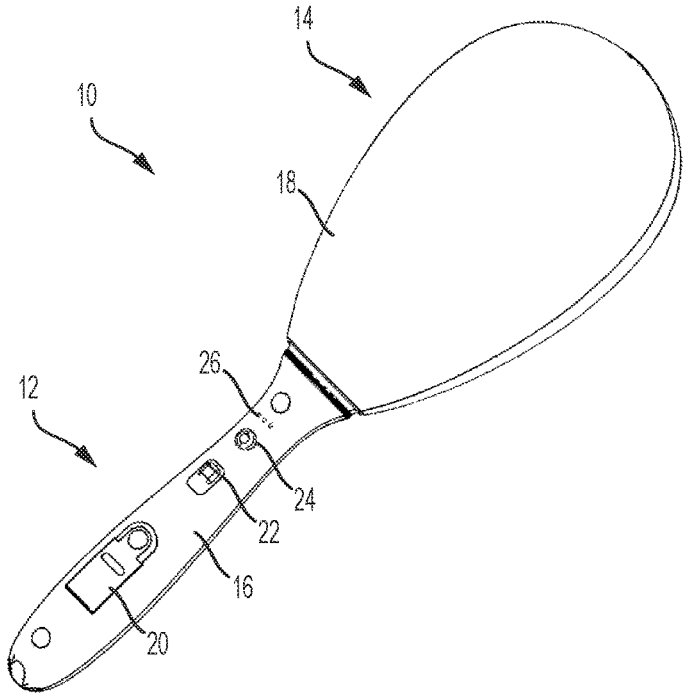
FIG. 1 illustrates a perspective view of an example of an acoustic illumination device including a handle and a hollow chamber.

FIG. 1 illustrates a perspective view of a first example of an illuminated acoustic device 10. The illuminated acoustic device 10 may be any device which makes a percussive sound and which may be illuminated. Examples of the illuminated acoustic device 10 may include a rattle, a maraca, or a shaker. The illuminated acoustic device 10 may include a body having a handle 12 and a hollow chamber 14. The handle 12 may be any portion of the body of the illuminated acoustic device 10 which is capable of being gripped by a hand or some other object. Examples of the handle 12 may include a grip, a cylindrical surface, or a molded hand feature. The hollow chamber 14 may be any portion of the body which extends outward from the handle 12 and which may create a percussive sound when filled and shaken. Examples of the hollow chamber 14 may include a bulb, a globe, or a tear-drop shaped cavity.

The handle 12 may include a handle shell 16 which defines an outer surface of the handle 12 and contains at least a portion of the components of the handle 12. Examples of the handle shell 16 may include a nylon lining, a plastic outer coating, or any other suitable coating. As illustrated in FIG. 1, the handle 12 may include a battery cavity 20 containing batteries (28 in FIG. 2), an on/off switch 22, a mode switch 24, a control board (38 in FIG. 2), a lighting element (30 in FIG. 2), and indicator lights 26. The battery cavity 20 may be accessible through the handle shell 16 to allow batteries 28 to be freely inserted or replaced. Alternatively, the battery cavity 20 may be sealed by the handle shell 16 to prevent tampering with the batteries 28. The on/off switch 22 may project through the handle shell 16 and may be accessible by a user to power the illuminated acoustic device on or off. The mode switch 24 may also project through the handle shell 16 and may be accessible by the user to change the operation of the acoustic illuminated device. For example, the mode switch 24 may be used to change a color of illumination, to switch which lighting element may be activated, or to introduce a specific lighting effect, such as a time delay or a repeated flashing effect. The indicator light 26 may include of one or more lights which are visible through the handle shell 16. The indicator light 26 may indicate the powered state of the illuminated acoustic device 10 or may indicate the mode of operation of the illuminated acoustic device 10.

The hollow chamber 14 may include a chamber shell 18 which defines the outer surface of the hollow chamber 14 and contains all the components of the hollow chamber 14. The chamber shell 18 may also define an interior (40 in FIG. 2) of the hollow chamber 14. Examples of the chamber shell 18 may include a nylon lining, a plastic outer coating, or any other suitable material. The hollow chamber 14 may include a medium material (31 in FIG. 2). The medium material 31 may be any object, which when placed in the interior 40 of the hollow chamber 14 may be used to create a percussive sound when interacting with the chamber shell 18, other medium material 31, or some other percussive device within the interior 40 of the hollow chamber 14. The chamber shell 18 may be thick and rigid enough to withstand frequent impacts from the medium material 31, and may also be thin or translucent enough to allow the illumination from the lighting element 30 to at least partially pass through it.

Figure 2:
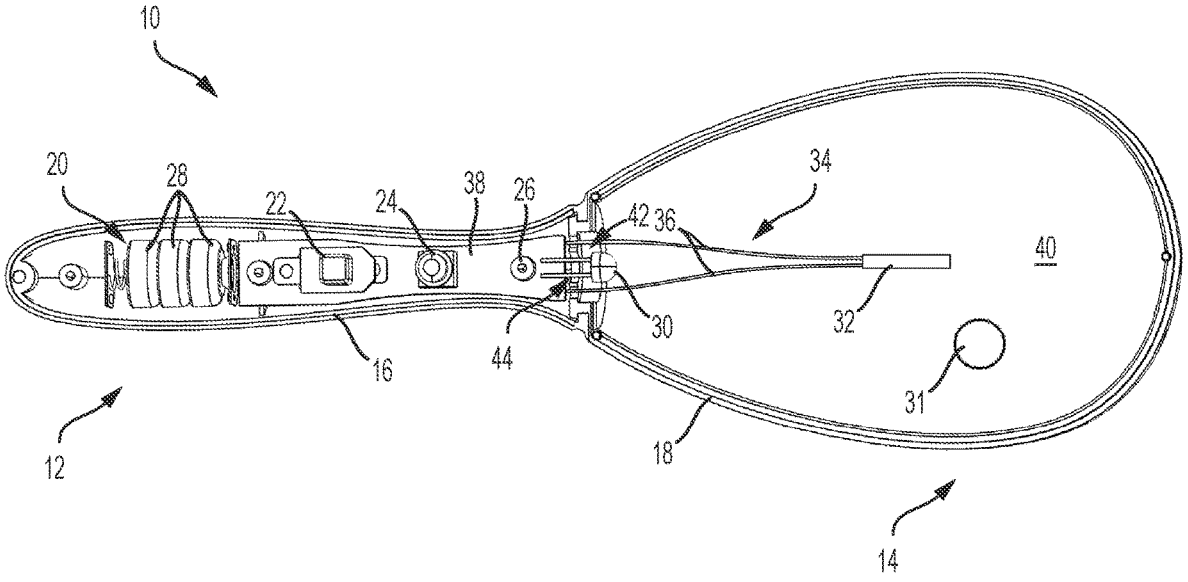
FIG. 2 illustrates a side cross-sectional view of a second example of the acoustic illumination device including the handle and the hollow chamber.

FIG. 2 illustrates a cross-sectional side view of another example of the illuminated acoustic device 10. In some embodiments, the illuminated acoustic device 10 may include a sensor 32 positioned within the interior 40 of the hollow chamber 14. The sensor 32 may be any component which is capable of controlling the operation of the lighting element 30. Examples of the sensor 32 may include an impact sensor, an accelerometer, or a piezoelectric vibration sensor.

As illustrated in FIG. 2, the sensor 32 may be suspended within the interior 40 of the hollow chamber 18 by an elongated element 34 extending between the sensor 32 and at least one of the chamber shell 18 of the hollow chamber 14 or the handle 12. Examples of the elongated element 34 may include a spring, a filament, or a wire. In the embodiment shown in FIG. 2, the elongated element 34 includes a pair of electrical wires 36 in electrical communication with the sensor 32. The electrical wires 36 may be any component which allows electrical communication between the sensor 32 and another component of the illuminated acoustic device 10. In some embodiments, for example, when the sensor 32 is an accelerometer, the sensor 32 may be positioned outside the hollow chamber 14. In such an embodiment, the sensor 32 may be placed in the handle 12.

The elongated element 34 may be rigid enough to maintain a position of the sensor 32 within the interior 40 of the hollow chamber 14, and may also be flexible enough to allow movement of the sensor 32 within the interior 40 of the hollow chamber 14 when the illuminated acoustic device 10 is moved, or when medium material 31 impacts the sensor 32. For example, in the embodiment illustrated in FIG. 2, the electrical wires 36 comprising the elongated element 34 may have an outer layer of hardened rubber or some other material to allow a degree of movement for the sensor 32. Additionally, the rubber coating of the electrical wires 36 may be sufficiently rigid to return the sensor 32 to a resting position when the illuminated acoustic device 10 is motionless.

The lighting element 30 may be arranged within the body of the illuminated acoustic device 10 and may be arranged to illuminate the interior 40 of the hollow chamber 14. The lighting element 30 may be any component capable of creating light from an electrical source. For example, the lighting element 30 may be a light-emitting diode (LED), a fluorescent bulb, or an incandescent light. The lighting element 30 may be positioned entirely within the handle 12 or may extend partially into the hollow chamber 14. The lighting element 30 may be configured to project a single color or may selectively emit light of a variety of colors.

As illustrated in FIG. 2, the lighting element 30 may be arranged within a cavity 42 positioned between the handle 12 and the interior 40 of the hollow chamber 14. The cavity 42 may include passages 44 extending between the cavity 42 and the handle 12 to allow for wires 36 to extend into the handle 12 from the sensor 32 and the lighting element 30. The cavity 42 may be large enough to receive the lighting element 30 and may be small enough to prevent movement of the medium material 31 from the interior 40 of the hollow chamber 14 into the handle 12. In some embodiments, a packing material (not shown) may be placed within the cavity 42 to effectively seal the handle 12 from the interior 40 of the hollow chamber 14.

As shown in FIG. 2, the handle 12 may include a control board 38 in connection with the lighting element 30, the sensor 32, the mode switch 24, the indicator light 26, and the on/off switch 22. The control board 38 may receive power from the on/off switch 22 and may control operation of the lighting element 30 through inputs from the sensor 32 and the mode switch 24. For example, in one mode of operation, when the sensor 32 may be triggered to send an electrical signal to the control board 38. The control board 38 may then send an electrical signal to the lighting element 30 to activate illumination of the hollow chamber 14. Furthermore, the mode switch 24 may activated to change the operation of the control board 38, for example, by introducing a time delay between the sensor 32 and the lighting element 30, by controlling the period of the electrical signal to the lighting element 30, or by changing the color of the light emitted from the lighting element 30.

In some embodiments, the control board 38 may be used to time the brightening and fading of the lighting element 30 in coordination with the sensor 32. For example, in one embodiment, the lighting element 30 may brighten quickly as soon as the sensor 32 is activated, and then slowly fade if the sensor 32 is not activated again. This may create the visualization of a pulsing effect as the lighting element 32 brightens every time the sensor 32 is activated by the shaking of the illuminated acoustic device 10. A time for brightening of the lighting element 30 may be between 500 milliseconds and 1 second. A time for fading of the lighting element 30 may be between 500 milliseconds and 3 seconds. The pulsing effect of the lighting element 30 may be accomplished by a simple RC circuit in the control board 38 or a digital circuit.

In some embodiments, the mode switch 24 may be used to change the pulsing color of the lighting element 30. For example, in one mode, the lighting element 30 may pulse in the same color for every sensor 32 activation. In another embodiment, the color of the lighting element 30 may change each time the sensor 32 is activated. The change of colors may be random from a selected number of colors, may be ordered in a pre-arranged sequential pattern, or may be programmed into a sequential order by the user.

In one embodiment, the sensor 32 may be an accelerometer. In such an example, shaking the illuminated acoustic device 10 may induce an acceleration on the sensor 32 causing an electrical signal to be sent to the control board 38, and thereby causing the lighting element 30 to illuminate the hollow chamber 14. In such an embodiment the sensor 32 may be configured to control an intensity of the lighting element 30 proportionally relative to an acceleration detected by the sensor 32.

Alternatively, in another embodiment, the sensor 32 may be an impact sensor. In such an embodiment, shaking the illuminated acoustic device 10 may cause intermittent contact between the medium material 31 and the sensor 32. When contact occurs, the sensor 32 may send a signal to the control board 38, causing the lighting element 30 to illuminate the hollow chamber 14. In such an embodiment, the percussive noise of the medium material 31 striking the sensor may align with the illumination of the hollow chamber 14, creating closely-linked visual and auditory experiences.

As illustrated in FIG. 2, batteries 28 may be placed within the battery cavity 20 to power the illuminated acoustic device 10. The batteries 28 may be in electrical communication with the control board 38 through the on/off switch 22.

Figure 3:
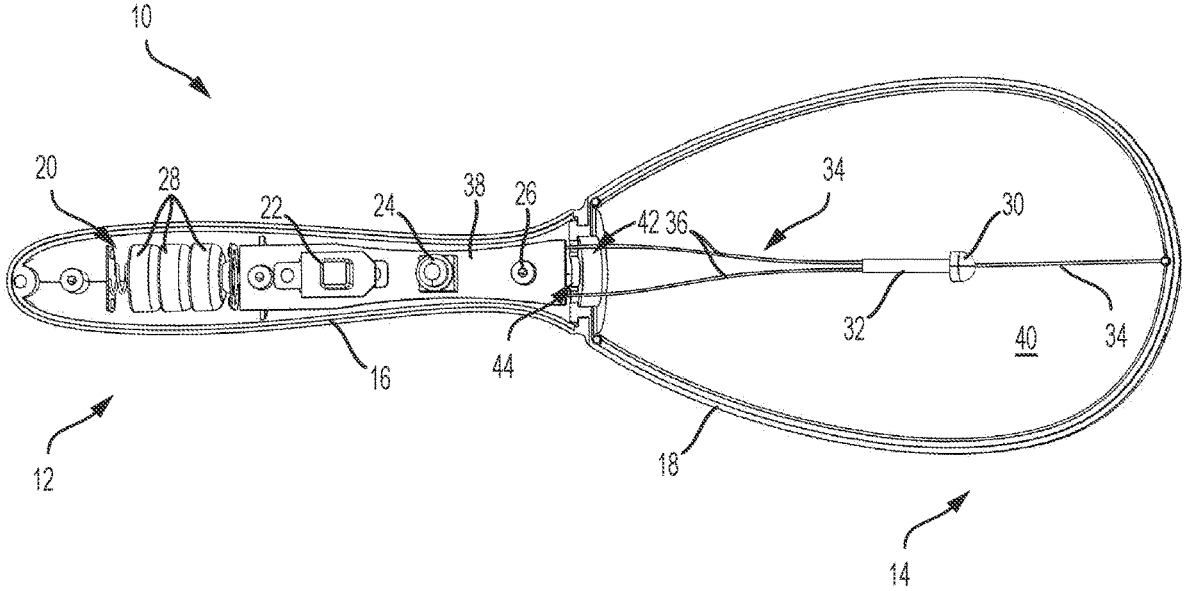
FIG. 3 illustrates a side cross-sectional view of a third example of the acoustic illumination device including the handle and the hollow chamber.

FIG. 3 illustrates a side cross-sectional view of another example of the illuminated acoustic device 10. As shown, in some embodiments, the lighting element 30 may be suspended within the interior 40 of the hollow chamber 14. It may be positioned alongside the sensor 32 to project light radially throughout the hollow chamber 14 instead of directionally from the handle 12. Such a configuration may produce different or better lighting effects and may require multiple lighting elements 30 to evenly project light in every direction.

In some embodiments, the range of movement of the sensor 32 within the interior 40 of the hollow chamber 14 may be limited to prevent the sensor 32 from impacting the chamber shell 18 and potentially being damaged. In such an embodiment, it may be desirable for the sensor 32 to be coupled to multiple elongated elements 34 on opposing sides of the sensor 32. For example, a first elongated element 34 may be coupled to the handle 12 while the second elongated element 34 may be coupled to the chamber shell 18. Both elongated elements 34 may be flexible enough to allow interaction between the sensor 32 and the medium material 31, but may restrict movement of the sensor 32 sufficiently to prevent the sensor 32 from colliding with the chamber shell 18.

Figure 4:
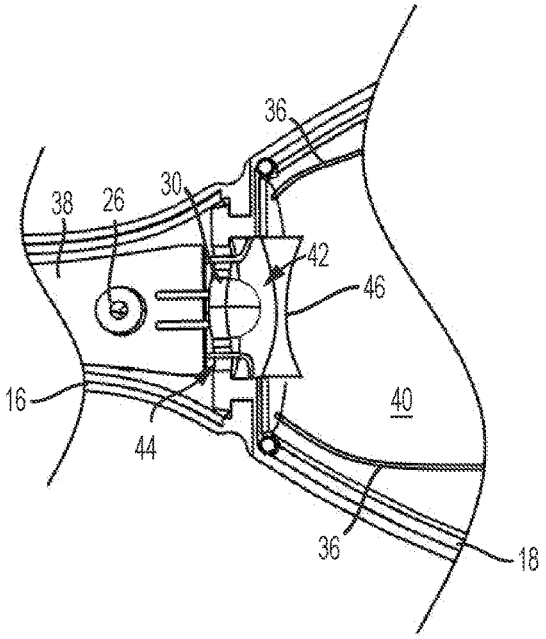
FIG. 4 illustrates a side cross-sectional view of a fourth example of the acoustic illumination device including a lighting element and a screen.

FIG. 4. Illustrates a partial cross-sectional side view of another embodiment of the illuminated acoustic device 10. In some embodiments, a screen 46 may be positioned between the interior 40 of the hollow chamber 14 and the lighting element 30. The screen 46 may be any component which extends over the lighting element 30 and seals the interior 40 of the hollow chamber 14 from the lighting element 30, thereby preventing medium material 31 from directly contacting the lighting element 30. Examples of the screen 46 may include a transparent film, a lens, or a translucent shell. In such an embodiment, the screen 46 may be positioned within the cavity 42 containing the lighting element 30. Alternatively, the screen 46 may be coupled to the chamber shell 18. The screen 46 may be transparent or translucent to permit the lighting element to illuminate the hollow chamber 14.

In some embodiments, the screen 46 may be a lens arranged to scatter light passing from the lighting element 30 and into the interior 40 of the hollow chamber 14. For example, where an arc of illumination of the lighting element 30 may be small, a concave-concave lens, or some other light scattering lens, may efficiently scatter light from the lighting element 30 to more evenly distribute light across the entirety of the hollow chamber 14. Such an arrangement may enhance the visual display of the illuminated acoustic device 10.

In some embodiments, a go-bo (go between) may be incorporated into the screen 46. For example, words or a logo may be etched to the screen 46 or affixed to the screen 46 to allow light from the lighting element 30 to project an image onto the chamber shell 18. This image may be seen from outside the hollow chamber 18 when the lighting sensor 30 is activated. Alternatively, the go-bo may be arranged anywhere within the interior 40 of the hollow chamber 18 where it will interact with light from the lighting element 30. For example, the go-bo may be arranged proximate to the sensor 32 or may be etched into an inner surface of the chamber shell 18. In some embodiments, such as where the go-bo is affixed to a lens form of the screen 46, the shape of the go-bo may be modified to accommodate the focal length of the lens to project a clear and undistorted image onto the chamber shell 18.

Figure 5:
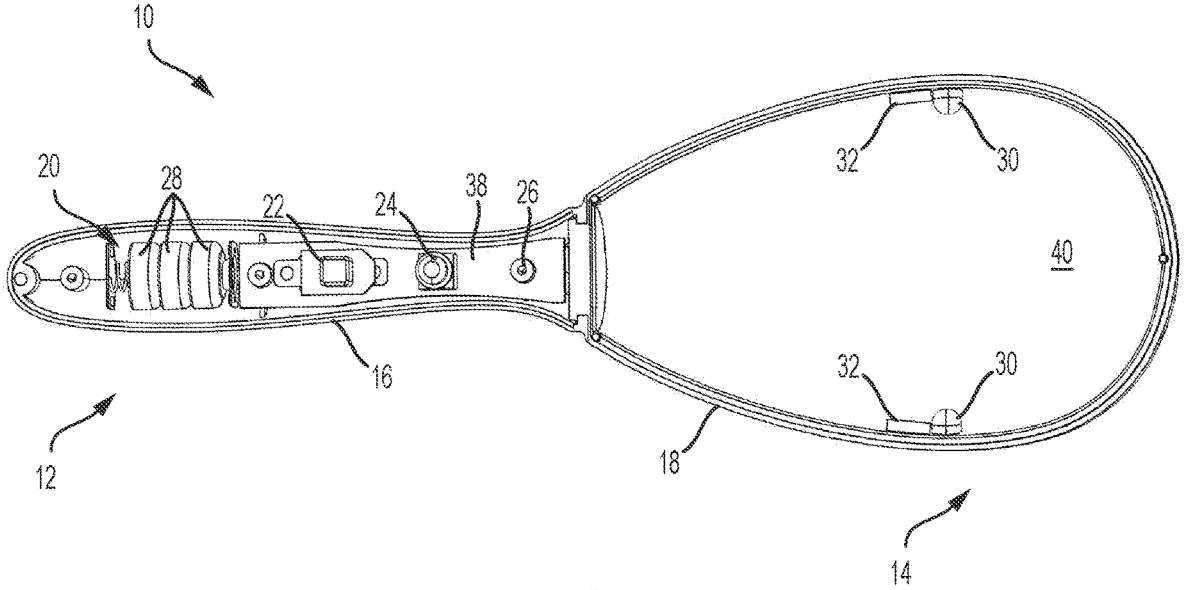
FIG. 5 illustrates a side cross-sectional view of a fifth example of the acoustic illumination device including the handle and the hollow chamber.

FIG. 5 illustrates a cross-sectional side view of yet another embodiment of the illuminated acoustic device 10. In some embodiments, multiple sensors 32 and multiple lighting elements 30 may be used to create complex interactions between the user and the visual display of the illuminated acoustic device 10. For example, in one embodiment, each of the multiple lighting elements 30 may be configured to activate only when a specific condition is met by one or more of the sensors 32. If a first sensor 32 experiences an upward acceleration, a first lighting element 30 may activate. If a second sensor 32 experiences a downward acceleration, a second lighting element 30 may activate. The first and second lighting elements 30 may produce different colors of light such that shaking the illuminated acoustic device 10 up and down may produce alternating flashes of changing light.

In another possible embodiment, multiple impact sensors 32 could be placed about the interior 40 of the hollow chamber 14, each sensor 32 coupled to a corresponding lighting element 30. The medium material 31 may interact with one of the sensors 32, causing the corresponding lighting element 30 may activate. In such an embodiment, the uneven distribution of medium material 31 within the hollow chamber 14 may cause an exciting and unpredictable visual display when the illuminated acoustic device 10 is shaken.

As illustrated in FIG. 5, in some embodiments, the sensor 32 and the lighting element 30 may be arranged on an inner surface of the chamber shell 18 of the hollow chamber 14.

In such an embodiment, the elongated element 34 may not be present. Additionally, the wire 36 may run extend to the sensor 32 and lighting element 30 through the interior 40 of the hollow chamber 14 or may extend through a wall of the chamber shell 18.

Figure 6:
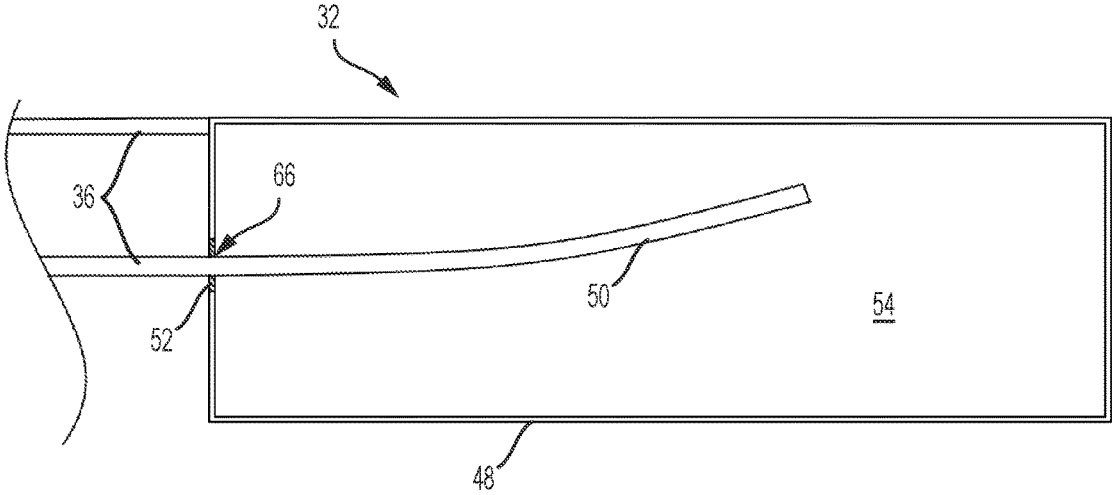
FIG. 6 illustrates a side cross-sectional view of an example of a sensor.

FIG. 6 illustrates a side cross-sectional view of an example of the sensor 32. In some embodiments, particularly when the sensor 32 is an impact sensor, the sensor 32 may include a container 48 and a flexible element 50 inside the container 48. The container 48 may be any component which is electrically conductive with the flexible element 50 and which at least partially encloses the flexible element 50. Examples of the container 48 may include a box, a cylinder, or a spherical shell. The container 48 may be made from a variety of electrically conductive materials such as aluminum, steel, iron, or copper. The flexible element 50 may be any component which is electrically conductive and extends into the container 48. Examples of the flexible element 50 may include a spring, a filament, or a wire.

As illustrated in FIG. 6, the flexible element 50 may extend into a sensor chamber 54 of the container 48 through an opening 66 in the container 48. Each of the container 48 and the flexible element 50 may be coupled to a wire 36, such that when the flexible element 50 comes in contact with the container 48, electrical current may flow, for example, from a first wire 36 to the flexible element 50, to the container 48, and into a second wire 36. To prevent unintended electrical transmission, the opening 66 of the container 48 may include an insulating material 52 to electrically separate the container 48 and the flexible element 50.

When the sensor 32 comes into contact with the medium material 31, or when the sensor 32 is shaken, the flexible element 50 may come into contact with the container 48, creating an electrical circuit. When the electrical circuit is completed, the lighting element 30 may be activated, causing the illumination of the hollow chamber 14.

Figure 7:
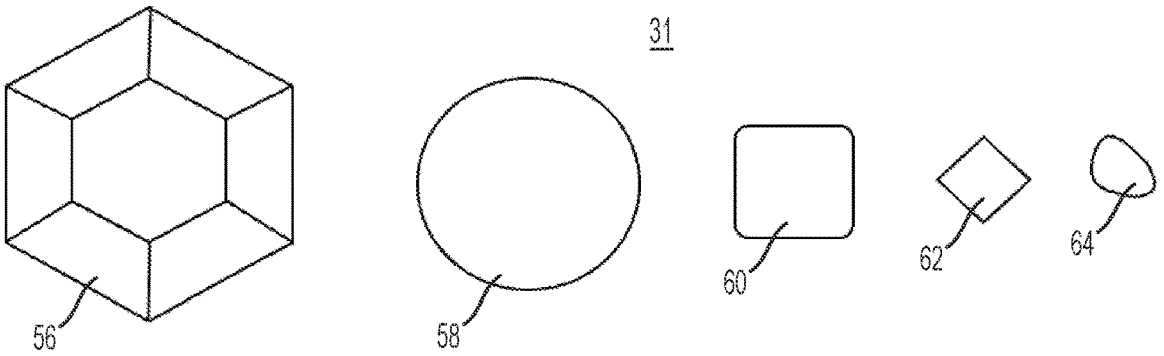
FIG. 7 illustrates a plan view of several examples of a medium material.

FIG. 7 illustrates plan views of a variety of medium material 31. The size and shape of the medium material 31 may vary based on the desired auditory and visual performance of the illuminated acoustic device 10. For example, in one embodiment the medium material 31 may include large reflective objects having complex geometric shapes (56). Such objects would cause less frequent impacts with the sensor 32 and may reflect light from the lighting element 30 in interesting and desirable patterns. In another embodiment, the medium material 31 may include spherical objects (58). In yet another embodiment, the medium material may include rounded cubes (60) or diamond shaped objects (62). In some embodiments, the medium material 31 may include small irregular translucent objects (64), such as gravel or quartz particulate matter. Such an embodiment may create more frequent impacts with the sensor 32 and may partially reflect light from the lighting element 30 in different and desirable patterns.

The size of the medium material 31 may be between 2 mm-25 mm. In some embodiments, the medium material 31 may be electrically non-conductive to avoid interference with other electrical components of the illuminated acoustic device 10.

Figure 8:
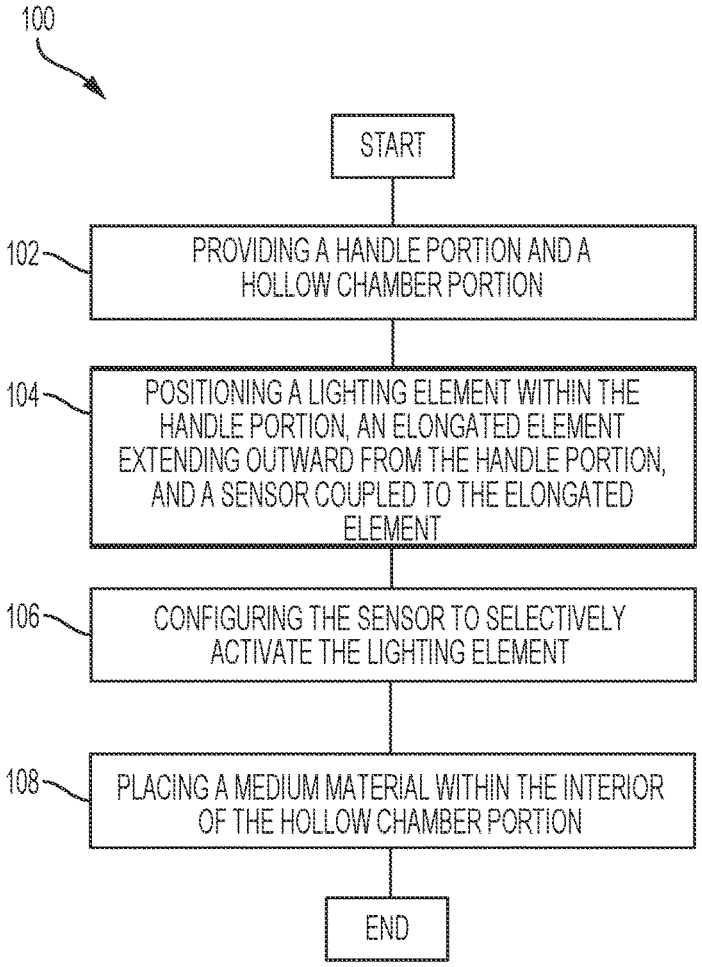
FIG. 8 illustrates a flow diagram of example operations to perform as part of a method of manufacturing an acoustic illumination device.

FIG. 8 illustrates a method of manufacturing the illuminated acoustic device 10. In such a method, the handle 12 portion and the hollow chamber 14 portion may be provided (102). The lighting element 30 may be positioned within the handle 12, the elongated element 34 may be positioned extending outward from the handle 12, and the sensor 32 may be positioned coupled to the elongated element 34 (104). The sensor 32 may be configured to selectively activate the lighting element 30 (106). The medium material 31 may be placed within the interior 40 of the hollow chamber 14 (108).

In some embodiments, for example, when a plurality of sensors 32 and a plurality of lighting elements 30 are present, the method may include configuring each sensor 32 to control a respective lighting element 30.

Furthermore, although specific components are described above, methods, systems, and articles of manufacture described herein may include additional, fewer, or different components. For example, in some embodiments, the elongated element 34 may not be present, or multiple elongated elements 34 may be present.

In addition to the advantages that have been described, it is possible that there are other advantages that are not currently recognized. However, these advantages which may become apparent at a later time. While various embodiments have been described, it will be apparent to those of ordinary skill in the art that many more embodiments and implementations are possible. Accordingly, the embodiments described herein are examples, not the only possible embodiments and implementations.

We claim:

1. An illuminated acoustic device, comprising:

a body comprising a handle and a hollow chamber extending outward from the handle;

a lighting element arranged within the body and configured to illuminate an interior of the hollow chamber;

a sensor positioned within the hollow chamber, wherein the sensor is configured to control the lighting element, wherein the sensor comprises a flexible element arranged within a container, and wherein the container and the flexible element are electrically conductive such that contact between the flexible element and the container activates the sensor; and a medium material arranged within the interior of the hollow chamber.

2. The illuminated acoustic device of claim 1, wherein the sensor is suspended within the interior of the hollow chamber by an elongated element extending between the sensor and at least one of a shell of the hollow chamber or the handle.

3. The illuminated acoustic device of claim 2, wherein the elongated element is flexible to allow movement of the sensor within the interior of the hollow chamber.

4. The illuminated acoustic device of claim 3 wherein the elongated element comprises at least one electrical wire in communication with the sensor.

5. The illuminated acoustic device of claim 1, wherein the sensor includes an accelerometer.

6. The illuminated acoustic device of claim 5, wherein the sensor is configured to control an intensity of the lighting element proportionally relative to an acceleration detected by the accelerometer.

7. The illuminated acoustic device of claim 1, wherein the medium material is electrically non-conductive.

8. The illuminated acoustic device of claim 1, wherein the sensor is coupled to an inner surface of the hollow chamber.

9. The illuminated acoustic device of claim 1, wherein the medium material comprises a plurality of reflective objects.

10. The illuminated acoustic device of claim 1, wherein the lighting element comprises a light-emitting diode.

11. The illuminated acoustic device of claim 10, wherein the lighting element is arranged within the handle and directed to illuminate the interior of the hollow chamber.

12. The illuminated acoustic device of claim 1, wherein the lighting element is suspended within the interior of the hollow chamber by a flexible element extending between the lighting element and at least one of an inner surface of the hollow chamber or the handle.

13. The illuminated acoustic device of claim 1, wherein the lighting element is arranged on an inner surface of the hollow chamber.

14. An illuminated acoustic device, comprising:

a body comprising a handle and a hollow chamber coupled to the handle;

a light-emitting diode arranged within the handle and directed to illuminate an interior of the hollow chamber;

a sensor suspended within the hollow chamber by a flexible element extending between the sensor and the handle, wherein the sensor includes an accelerometer, and wherein the sensor is configured to control an intensity of the light-emitting diode proportionally relative to an acceleration detected by the accelerometer; and a medium material arranged within the interior of the hollow chamber.

15. The illuminated acoustic device of claim 14, further comprising a screen positioned between the hollow chamber and the light-emitting diode, wherein the screen seals the interior of the hollow chamber from the light-emitting diode and allows illumination of the interior of the hollow chamber from the light-emitting diode.

16. The illuminated acoustic device of claim 15, wherein the screen is a lens configured to scatter light passing from the light-emitting diode and into the interior of the hollow chamber.

17. A method of manufacturing an illuminated acoustic device, comprising:

providing a handle portion and a hollow chamber portion;

positioning a lighting element within the handle portion, an elongated element extending outward from the handle portion, and a sensor coupled to the elongated element, wherein the lighting element is arranged to illuminate an interior of the hollow chamber portion, and the sensor is suspended within the interior of the hollow chamber portion;

configuring the sensor to selectively activate the lighting element, wherein configuring the sensor includes controlling an intensity of an illumination of the lighting element proportionally to an acceleration detected by the sensor; and placing a medium material within the interior of the hollow chamber portion.

18. The method of claim 17, wherein configuring the sensor includes configuring each of a plurality of sensors to control a respective lighting element of a plurality of lighting elements.

19. The method of claim 17, wherein configuring the sensor includes controlling a brightening time of the lighting element when the lighting element is activated.

20. The method of claim 19, wherein configuring the sensor includes controlling a fading time of the lighting element after controlling the brightening time, and wherein the brightening time is shorter than the fading time.

* * * * *